US012716673B1

(12) United States Patent
Dwyer

(10) Patent No.: US 12,716,673 B1
(45) Date of Patent: Aug. 25, 2026

(54) SYNTHETIC TRIGGER SYSTEM

(71) Applicant: Biofire Technologies Inc., Broomfield, CO (US)

(72) Inventor: Benjamin William Dwyer, Golden, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 18/585,824

(22) Filed: Feb. 23, 2024

Related U.S. Application Data

(60) Provisional application No. 63/486,921, filed on Feb. 24, 2023.

(51) Int. Cl.
*F41A 17/46* (2006.01)
*F41A 19/59* (2006.01)

(52) U.S. Cl.
CPC ..... *F41A 19/59* (2013.01); *F41A 17/46* (2013.01)

(58) Field of Classification Search
CPC ..... F41A 19/16; F41A 19/12; F41A 17/46; F41A 17/54; F41A 19/10
USPC ..... 42/69.01–69.3
See application file for complete search history.

(56) References Cited

U.S. PATENT DOCUMENTS 4,450,751 A * 5/1984 Thevis ..... F41A 19/02 89/129.02
4,908,970 A * 3/1990 Bell ..... F41A 19/12 42/69.01
11,274,894 B1 * 3/2022 Hill ..... F41A 17/46
2020/0248979 A1 * 8/2020 Dunham ..... F41C 7/06

FOREIGN PATENT DOCUMENTS

AT 15313 U1 * 5/2017 ..... F41C 3/00
WO WO-2023192229 A1 * 10/2023 ..... F41A 19/59

* cited by examiner

*Primary Examiner* — Jonathan C Weber
(74) *Attorney, Agent, or Firm* — Ashurst Perkins Coie US LLP; Andrew T. Pettit

(57) ABSTRACT

The present disclosure provides systems and techniques for a trigger system that can be implemented in a gun. The trigger system may include a trigger body affixed to a pivot, a trigger detent affixed to the pivot, and a detent biasing device configured to bias the trigger detent away from the trigger body such that a detent surface protrudes from the trigger body. The trigger detent may be moveable along a displacement path, and an obstructing surface that is configured to remain substantially stationary relative to the trigger detent may be located in the displacement path of the trigger detent. The trigger detent may be configured to contact the obstructing surface while moving along the displacement path, move linearly away from the obstructing surface by compressing the detent biasing device, and move past the obstructing surface based on a threshold amount of force being applied to the trigger body.

19 Claims, 12 Drawing Sheets

100

200

700

800

1000

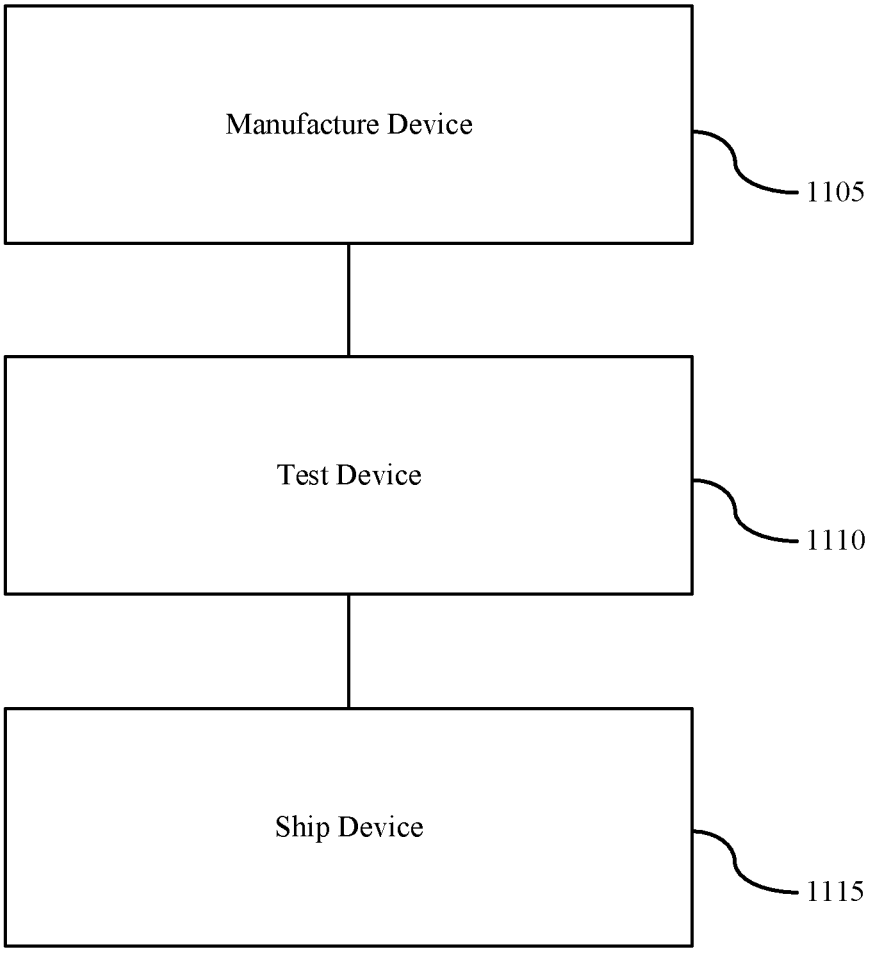
FIG. 11
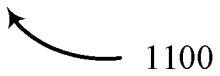

1200

SYNTHETIC TRIGGER SYSTEM

CROSS-REFERENCE TO RELATED APPLICATIONS

This application claims priority to U.S. Provisional Application No. 63/486,921, titled "SYNTHETIC TRIGGER SYSTEM" and filed on Feb. 24, 2023, which is incorporated by reference herein in its entirety.

FIELD OF TECHNOLOGY

The teachings disclosed herein generally relate to guns, and more specifically to trigger systems.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support a synthetic trigger that is implementable in a gun. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the systems and techniques described herein provide a trigger system that can be implemented in a gun. The trigger system may include a trigger body affixed to a pivot such that the trigger body can move about the pivot, a trigger detent affixed to the pivot such that the trigger detent can move about the pivot, and a detent biasing device configured to bias the trigger detent away from an aperture of the trigger body such that a detent surface protrudes from the aperture. The trigger body and the trigger detent may be configured to move about the pivot in unison. The trigger detent may be moveable along a displacement path, and an obstructing surface that is configured to remain substantially stationary relative to the trigger detent may be located in the displacement path of the trigger detent. The trigger detent may be configured to contact the obstructing surface while moving along the displacement path, move linearly away from the obstructing surface by compressing the detent biasing device, and move past the obstructing surface based on a threshold amount of force being applied to the trigger body and/or the trigger detent. For example, a user may apply force to the trigger body, and the trigger body may transfer force onto the trigger detent. A trigger break may be defined by the point at which the trigger detent moves past the obstructing surface, and a trigger sensor may generate an electrical signal based on the trigger detent moving past the obstructing surface.

BRIEF DESCRIPTION OF THE DRAWINGS

FIG. 11 illustrates an example of a flowchart showing a method of manufacturing a device.

Figure 1:
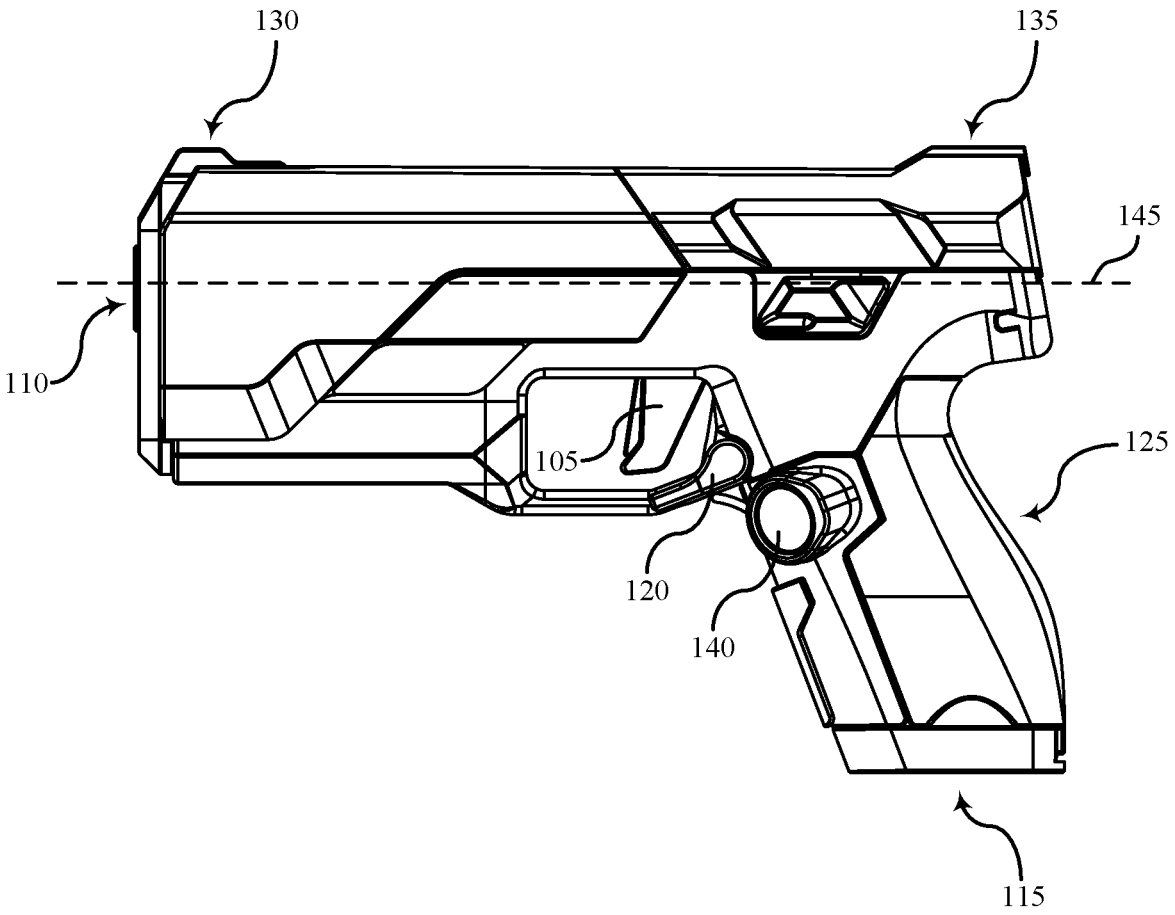
FIG. 1 illustrates an example of a gun that supports simulating a conventional trigger feel.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

In conventional guns, the trigger is mechanically connected to the sear, providing the shooter with the ability to move the sear and release the striker or hammer by pulling the trigger. The mechanical connection between the trigger and sear also produces a trigger with a characteristic feel that is largely the result of the sear releasing the striker or hammer. For example, a trigger bar is often used to mechanically couple the trigger with the sear such that pulling the trigger results in movement of the sear, and sufficient movement of the sear allows the release of the striker or hammer, causing the firing pin to collide with the cartridge primer, ignite the propellant, and propel a projectile from the gun.

A gun includes a trigger system that enables the shooter (also referred to as a "user") to operate the gun. In conventional guns, the trigger system provides a mechanical connection between the trigger and the sear, but this type of connection imposes constraints on the trigger weight and feel. For example, trigger systems often include safety features, but when the trigger is mechanically connected to the sear, constraints are imposed on the types of safety features that may be used. For example, a drop safety may be used to prevent the sear from inadvertently moving and releasing the striker or hammer, but a shooter may damage or incorrectly install the drop safety, thereby resulting in a gun that is prone to accidental discharges. Additionally, a user may desire a light trigger weight, but conventional guns that deliver a light trigger weight may have a precarious connection between the sear and striker or hammer, making the gun susceptible to accidental discharges.

Introduced here, therefore, is a synthetic trigger that delivers a familiar trigger feel while enabling the use of enhanced safety features. A synthetic trigger is a trigger that produces a trigger feel based on a trigger detent, such as a mechanical detent or an electromagnetic detent. The trigger feel may include stages of trigger travel, such as take up, a wall, a break, overtravel and reset. The synthetic trigger described herein can be used in both firing systems where the trigger is mechanically connected with a sear and firing systems where the trigger is not mechanically connected to a sear. The synthetic trigger described herein improves the safety of guns, as the synthetic trigger may be used in guns where the trigger is not mechanically coupled with the sear. Additionally, the synthetic trigger described herein improves the adjustability of the trigger feel.

A trigger system may include a trigger body, a trigger detent, and a detent biasing device. An aperture of the trigger body may envelope a portion of the trigger detent, and the detent biasing device may bias the trigger detent such that a detent surface protrudes from the aperture of the trigger body. The trigger body and the trigger detent may be movably affixed to a pivot such that the trigger body and the trigger detent can rotate about the pivot. An obstructing surface may be located in the displacement path of the trigger detent, and a trigger break may be defined by the trigger detent moving past the obstructing surface. The obstructing surface may remain stationary relative to the trigger detent, and the trigger detent may be capable of both rotating about the pivot and translating linearly within the aperture of the trigger body. For example, the trigger detent may rotate about the pivot with the trigger body, and the trigger detent may move past the obstructing surface based on the trigger detent moving linearly into the aperture of the trigger body. The trigger detent may compress or otherwise act against the detent biasing device to move linearly into the aperture. In some examples, a trigger sensor may identify a trigger break based on the trigger detent moving past the obstructing surface, and an actuator may be activated based on the trigger break.

In some examples, activating the actuator results in the gun firing a round. For example, an electrical signal may activate the actuator such that the actuator releases a sear, a striker, or a hammer, and the gun may propel a projectile through the barrel based on the actuator mechanism releasing the sear, striker, or hammer. In another example, activating the actuator may increase the temperature of an electronic firing pin, and the electronic firing pin may ignite a propellant and cause a projectile to be propelled through the barrel. An actuator may include a temperature changing actuator, a solenoid-based actuator, a piezoelectric based actuator, a voice coil-based actuator, or the like. The synthetic trigger system described herein improves gun safety by allowing the trigger to be mechanically independent from the sear. For example, since a direct mechanical connection between the trigger and sear is not needed, the gun may use an electronic fire control mechanism that functions only for authorized users.

Embodiments may be described in the context of executable instructions for the purpose of illustration. For example, a processor housed in a gun may be described as being capable of executing instructions that permit the identification of trigger movement based on analyzing data generated by a trigger sensor, such as a load cell or a Hall effect sensor. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor do they necessarily refer to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

Several "biasing" devices are described herein. A biasing device should be understood as any type of device that stores and releases energy. Examples of biasing devices include spring devices, rubber devices, compressed gas devices, electromagnetic devices, and the like.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that is capable of implementing a synthetic trigger. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint scanner (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to describe data that is used to authenticate a user. For example, the gun 100 may collect authentication data from the user to determine that the user is authorized to operate the gun 100, and the gun 100 may be unlocked based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights-namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The gun 100 may include a trigger system including a synthetic trigger. The trigger system may include the trigger 105, and the trigger 105 may be affixed to a pivot such that the trigger 105 can move about the pivot. The trigger system may include a trigger detent affixed to the pivot such that the trigger detent can move about the pivot, and a detent biasing device configured to bias the trigger detent away from an aperture of the trigger 105 such that a detent surface protrudes from the aperture. The trigger detent may be moveable along a displacement path, and an obstructing surface that is configured to remain stationary relative to the trigger detent may be located in the displacement path of the trigger detent. The trigger detent may be configured to contact the obstructing surface while moving along the displacement path, move linearly away from the obstructing surface by compressing the detent biasing device, and move past the obstructing surface based on a threshold amount of force being applied to the trigger 105. A trigger break may be defined by the trigger detent moving past the obstructing surface, and a trigger sensor may generate an electrical signal based on the trigger detent moving past the obstructing surface.

Figure 2:
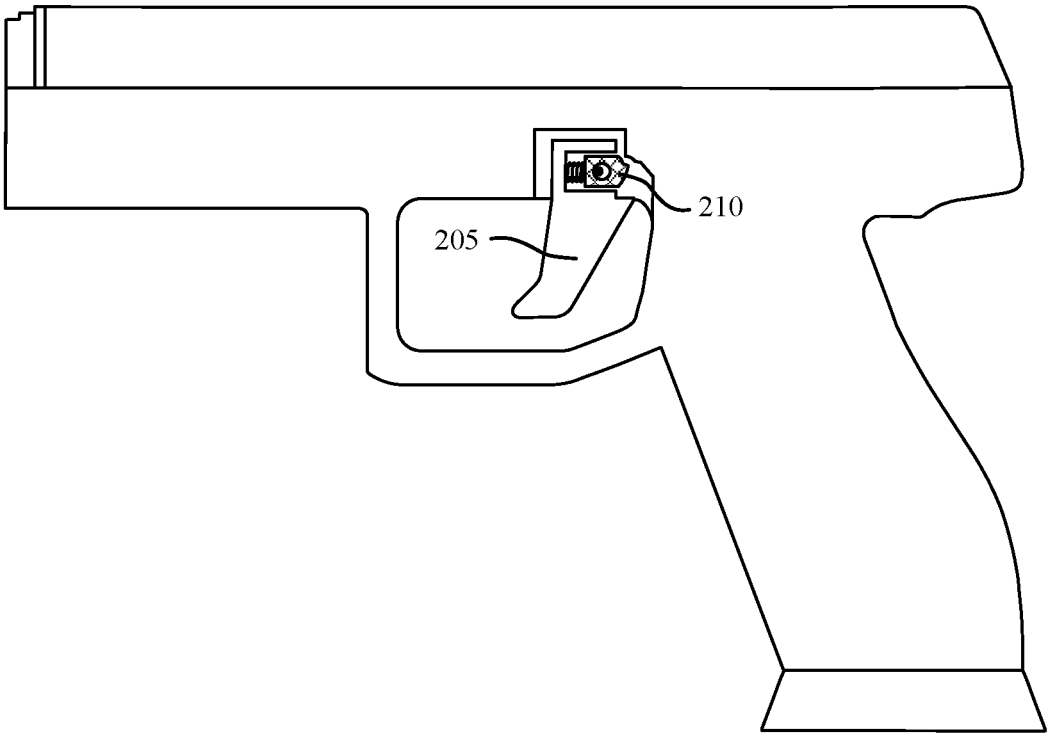
FIG. 2 illustrates an example of a gun including a synthetic trigger.

FIG. 2 illustrates an example of a gun 200 including a synthetic trigger. The synthetic trigger includes both a trigger body 205 and a trigger detent 210. The trigger detent 210 produces a force profile that results in a familiar trigger feel. For example, a user pulling the trigger body 205 may experience multiple phases of trigger travel, such as take up, a wall, a break, overtravel and reset. Aspect of the trigger detent 210 may be adjusted to modify the feel of the trigger. As an example, the size and/or shape of the trigger detent 210 may be changed to modify the amount of overtravel in the trigger. As another example, a spring may be used as a detent biasing device, and the spring constant of the spring may be changed to modify the weight of the trigger. FIG. 2 illustrates the trigger detent 210 as a mechanical detent, but it should be understood that a trigger detent may include a mechanical detent, an electromagnetic detent, or the like.

Figure 3:
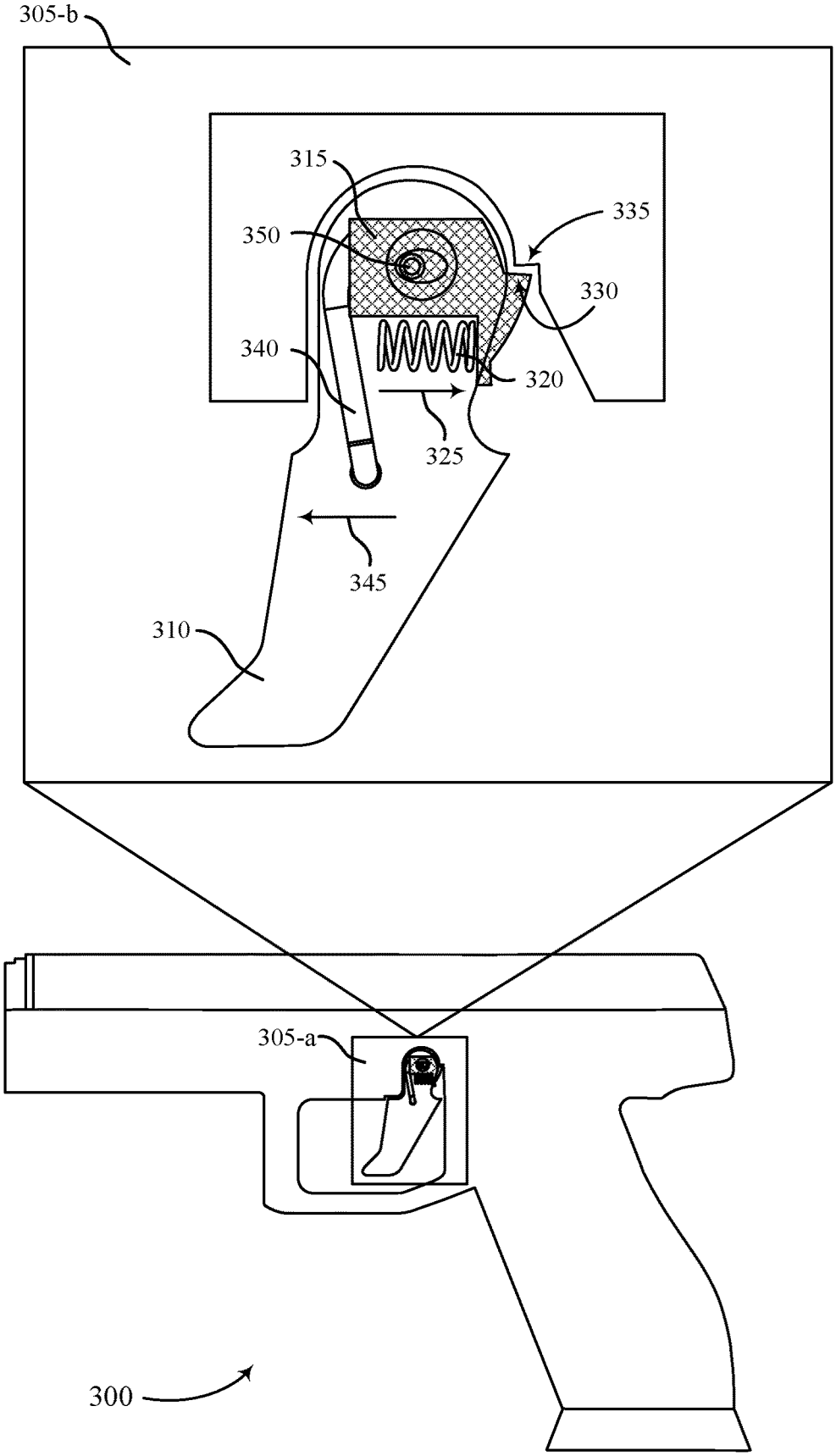
FIG. 3 illustrates an example of a gun including a synthetic trigger.

FIG. 3 illustrates an example of a gun 300 including a synthetic trigger. The window 305-*b* provides a zoomed in view of the window 305-*a*.

The trigger body 310 envelopes a trigger detent 315, and the detent biasing device 320 is configured to biases the trigger detent 315 in a direction illustrated by the arrow 325. The trigger biasing device 340 biases the trigger body 310 in a direction illustrated by the arrow 345. In some examples, the trigger biasing device 340 biases the trigger body 310 and the trigger detent 315 in the direction illustrated by the arrow 345. The arrow 345 may, for example, point towards the muzzle of the gun 300, and the arrow 325 may, for example, point away from the muzzle of the gun 300. The detent biasing device 320 biases the trigger detent 315 such that a detent surface 330 of the trigger detent 315 is blocked by an obstructing surface 335. The obstructing surface 335 may remain substantially or entirely stationary relative to the detent surface 330. For example, the obstructing surface 335 may be an aspect of a gun frame, and the detent surface 330 may be an aspect of a trigger detent that moves together with a trigger body.

The trigger body 310 may be rotatable about the axis 350. For example, while in the orientation illustrated in FIG. 3, the trigger body 310 may rotate about the axis 350 in a counterclockwise direction to cause the gun to fire, and the trigger body 310 may rotate about the axis 350 in a clockwise direction to reset the trigger. The trigger biasing device 340 may bias the trigger body 310 to rotate about the axis 350 in a clockwise direction.

Figure 4:
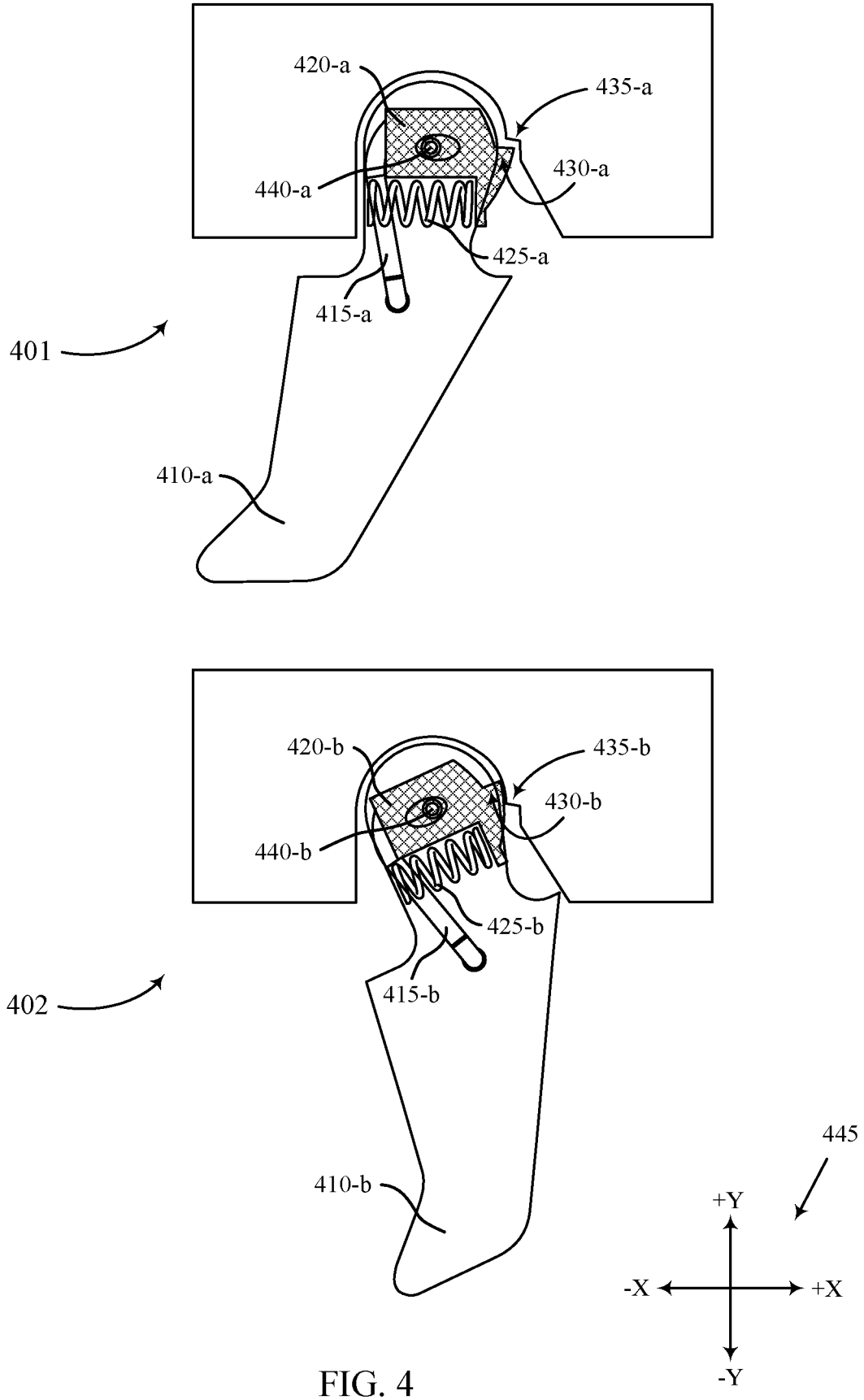
FIG. 4 illustrates examples of positions a synthetic trigger may assume.

FIG. 4 illustrates an example of a synthetic trigger 401 in an inactive position and an example a synthetic trigger 402 in an active position. An inactive position may be referred to as a default position, and an active position may be referred to as an engaged position. A synthetic trigger may be implemented in a fire control mechanism, a gun, a weapon, or the like.

The synthetic trigger 401 illustrates an example of a synthetic trigger in an inactive position (e.g., a default position). The trigger 410-*a* is biased forward (e.g., towards a muzzle of the gun, in the "−X" direction illustrated by the legend 445) based on the trigger biasing device 415-*a*. The trigger biasing device 415-*a* may be a mechanical spring, an electromagnetic biasing component, or the like. As an illustrative example, the trigger biasing device 415-*a* may be an example of a coil spring that envelopes the axis 440-*a* so as to bias the trigger 410-*a* in the inactive position.

The detent biasing device 425-*a* may bias the trigger detent 420-*a* such that the surface 430-*a* of the trigger detent 420-*a* is obstructed by the surface 435-*a*. For example, the detent biasing device 425-*a* may bias the trigger detent 420-*a* such that the surface 435-*a* is in a displacement path of the trigger detent 420-*a*. The surface 430-*a* may be referred to as a detent surface, the surface 435-*a* may be referred to as an obstructing surface, and the axis 440-*a* may be referred to as a pivot.

The synthetic trigger 402 illustrates an example of a synthetic trigger in an active position (e.g., an engaged position). The trigger body 410-*b* has rotated about the axis 440-*b*. The trigger body 410-*b* has experienced a "trigger beak" since the surface 430-*b* of the trigger detent 420-*b* has contacted the surface 435-*b* and moved past the surface 435-*b*. In some examples, the trigger break of a synthetic trigger may be defined by the trigger detent moving past the obstructing surface. To allow the surface 430-*b* to pass the surface 435-*b*, the detent biasing device 425-*b* has been compressed, and the trigger detent 420-*b* has moved forward (e.g., away from the surface 435-*b*, in the "−X" direction illustrated by the legend 445). The trigger biasing device 415-*b* may bias the trigger body 410-*b* in an inactive position. In some examples, the trigger detent 420-*b* may move linearly into an aperture of the trigger body 410-*b* in response to a force applied to the trigger body 410-*b*, and in order to allow the trigger detent 420-*b* to pass the surface 435-*b*. The surface 430-*b* may be referred to as a detent surface, the surface 435-*b* may be referred to as an obstructing surface, and the axis 440-*b* may be referred to as a pivot.

In some examples, the surface 435-*b* may include a spring mechanism. For example, the surface 435-*b* may include or otherwise define a leaf spring that stores and releases energy. Including a spring in the surface 435-*b* may improve the feel of the trigger, as the spring may improve the tactile and/or audible indication of resetting the trigger.

As an illustrative example, a gun may include a trigger that is biased in an inactive position by default. As a user pulls the trigger and a threshold amount of force is applied to the trigger, the trigger will "break," and the trigger will be in an active position. In conventional firearms, a trigger break is often the result of the sear releasing the striker or hammer, whereas in the synthetic trigger described herein, the trigger break is the result of a trigger detent passing an opposing surface. The feel (e.g., the travel distance, the force needed to overcome the "wall" and "break" the trigger, etc.) of a synthetic trigger may be configured by adjusting one or more aspects and the synthetic trigger, such a spring force, an angle of a detent surface, a radius size of a detent, or the like.

Figure 5:
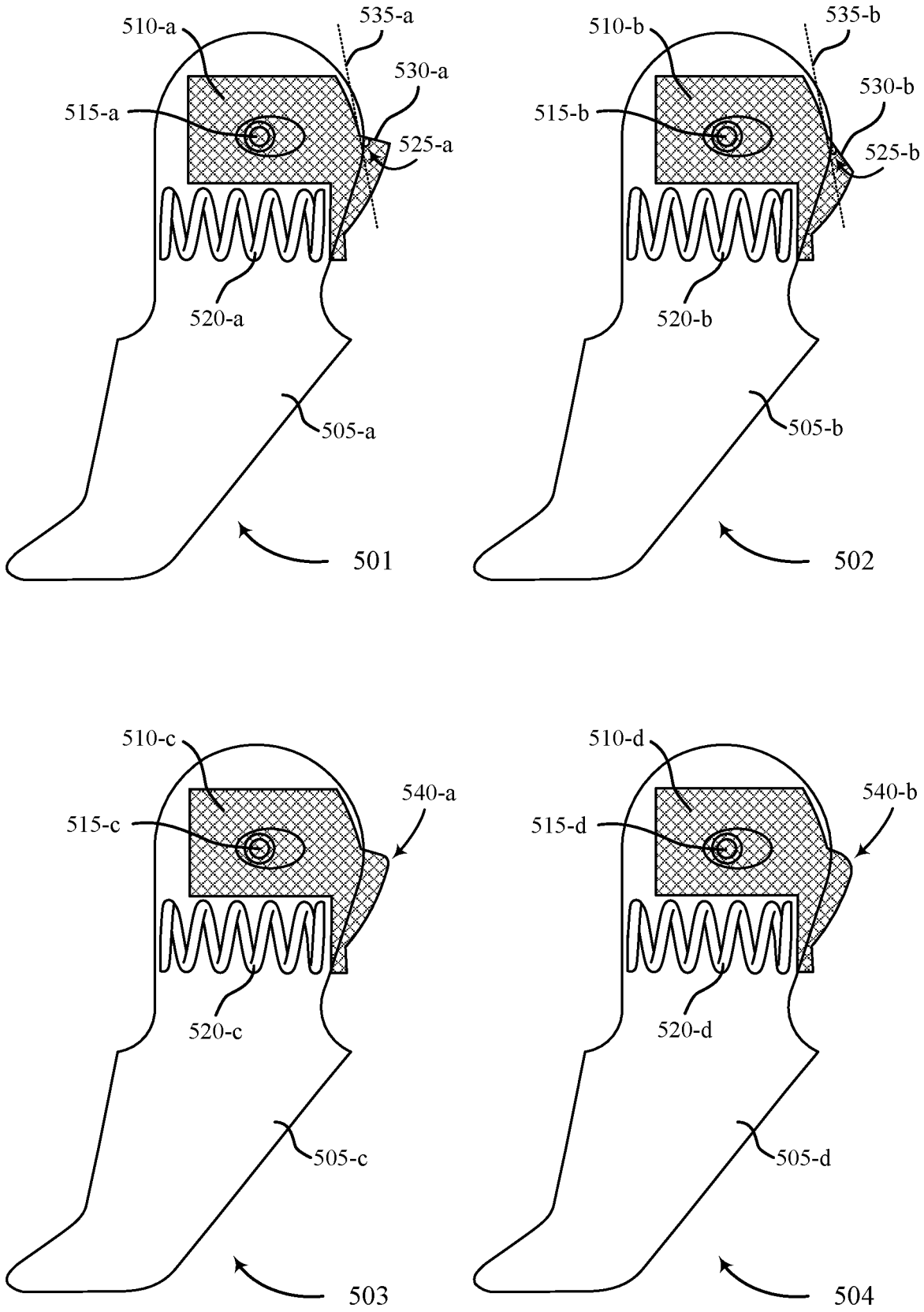
FIG. 5 illustrates examples of synthetic triggers showing adjustments that produce different trigger feels.

FIG. 5 illustrates examples of synthetic triggers that show adjustments that can be made to modify a trigger feel. For example, the synthetic trigger 501 shows an example of a trigger with a surface angle that may be considered large, the synthetic trigger 502 shows an example of a trigger with a surface angle that may be considered small, the synthetic trigger 503 shows an example of a trigger with a rounding that may be considered sharp, and the synthetic trigger 504 shows an example of a trigger with a rounding that may be considered smooth.

One or more aspects of a trigger may be modified to alter the feel of the trigger. Aspects of a trigger that may be modified to change the feel of the trigger include: the type of detent biasing device, the type of detent spring, the spring constant of the detent spring, the type of trigger reset spring, the spring constant of the trigger reset spring, the size of the detent, the shape of the detent, the material selection of the detent, the surface angle of the detent, the radius of the detent, or any combination thereof.

The synthetic trigger 501 includes a trigger body 505-*a* and a detent 510-*a*. The trigger body 505-*a* and/or the detent 510-*a* are rotatable about the axis 515-*a*. In some examples, the detent 510-*a* may be capable of moving linearly with respect to the axis 515-*a*. The spring 520-*a* may bias the detent 510-*a* towards a surface that obstructs the rotation of the detent 510-*a*. As the trigger body 505-*a* is rotated about the axis 515-*a*, the detent 510-*a* may move linearly with respect to the axis 515-*a* in response to coming in contact with the obstructing surface, and linear movement of the detent 510-*a* may enable rotational movement of the detent 510-*a* about the axis 515-*a*.

The detent 510-*a* includes a surface angle 525-*a*. The surface angle may be measured by the angle between the protruding surface 530-*a* and the line 535-*a* that is tangent to the surface of the detent 510-*a*. The surface angle 525-*a* may be considered a large surface angle because the surface angle 525-*a* is greater than a threshold angle. Examples of threshold angles include 20 degrees, 90 degrees, and all angles in between 20 degrees and 90 degrees. Larger surface angles may produce a heavier trigger weight by increasing the amount of force needed to move the trigger past the "break."

The synthetic trigger 502 includes a trigger body 505-*b* and a detent 510-*b*. The trigger body 505-*b* and/or the detent 510-*b* are rotatable about the axis 515-*b*. In some examples, the detent 510-*b* may be capable of moving linearly with respect to the axis 515-*b*. The spring 520-*b* may bias the detent 510-*b* towards a surface that obstructs the rotation of the detent 510-*b*. As the trigger body 505-*b* is rotated about the axis 515-*b*, the detent 510-*b* may move linearly with respect to the axis 515-*b* in response to coming in contact with the obstructing surface, and linear movement of the detent 510-*b* may enable rotational movement of the detent 510-*b* about the axis 515-*b*.

The detent 510-*b* includes a surface angle 525-*b*. The surface angle may be measured by the angle between the protruding surface 530-*b* and the line 535-*b* that is tangent to the surface of the detent 510-*b*. The surface angle 525-*b* may be considered a small surface angle because the surface angle 525-*b* is less than a threshold angle. Examples of threshold angles include 20 degrees, 90 degrees, and all angles in between 20 degrees and 90 degrees. Smaller surface angles may produce a lighter trigger weight by decreasing the amount of force needed to move the trigger past the "break." Smaller surface angles produce more linear force on the detent in response to the detent contacting an obstructing surface, so smaller surface angles produce lighter trigger weights.

The synthetic trigger 503 includes a trigger body 505-*c* and a detent 510-*c*. The trigger body 505-*c* and/or the detent 510-*c* are rotatable about the axis 515-*c*. In some examples, the detent 510-*c* may be capable of moving linearly with respect to the axis 515-*c*. The spring 520-*c* may bias the detent 510-*c* towards a surface that obstructs the rotation of the detent 510-*c*. As the trigger body 505-*c* is rotated about the axis 515-*c*, the detent 510-*c* may move linearly with respect to the axis 515-*c* in response to coming in contact with the obstructing surface, and linear movement of the detent 510-*c* may enable rotational movement of the detent 510-*c* about the axis 515-*c*.

The detent 510-*c* includes a rounded surface 540-*a*. The rounded surface 540-*a* may be considered sharp because the radius of the rounded surface 540-*a* is less than a threshold radius size. Examples of threshold radii include ½ millimeter, 10 millimeters, and all radii between ½ millimeter and 10 millimeters. Sharper surfaces may produce a heavier trigger weight and/or a more pronounced trigger reset.

The synthetic trigger 504 includes a trigger body 505-*d* and a detent 510-*d*. The trigger body 505-*d* and/or the detent

510-*d* are rotatable about the axis 515-*d*. In some examples, the detent 510-*d* may be capable of moving linearly with respect to the axis 515-*d*. The spring 520-*d* may bias the detent 510-*d* towards a surface that obstructs the rotation of the detent 510-*d*. As the trigger body 505-*d* is rotated about the axis 515-*d*, the detent 510-*d* may move linearly with respect to the axis 515-*d* in response to coming in contact with the obstructing surface, and linear movement of the detent 510-*d* may enable rotational movement of the detent 510-*d* about the axis 515-*d*.

The detent 510-*d* includes a rounded surface 540-*b*. The rounded surface 540-*b* may be considered smooth because the radius of the rounded surface 540-*a* is greater than a threshold radius size. Examples of threshold radii include ½ millimeter, 10 millimeters, and all radii between ½ millimeter and 10 millimeters. Smoother surfaces may produce a lighter trigger weight and/or a more subtle trigger reset.

Figure 6:
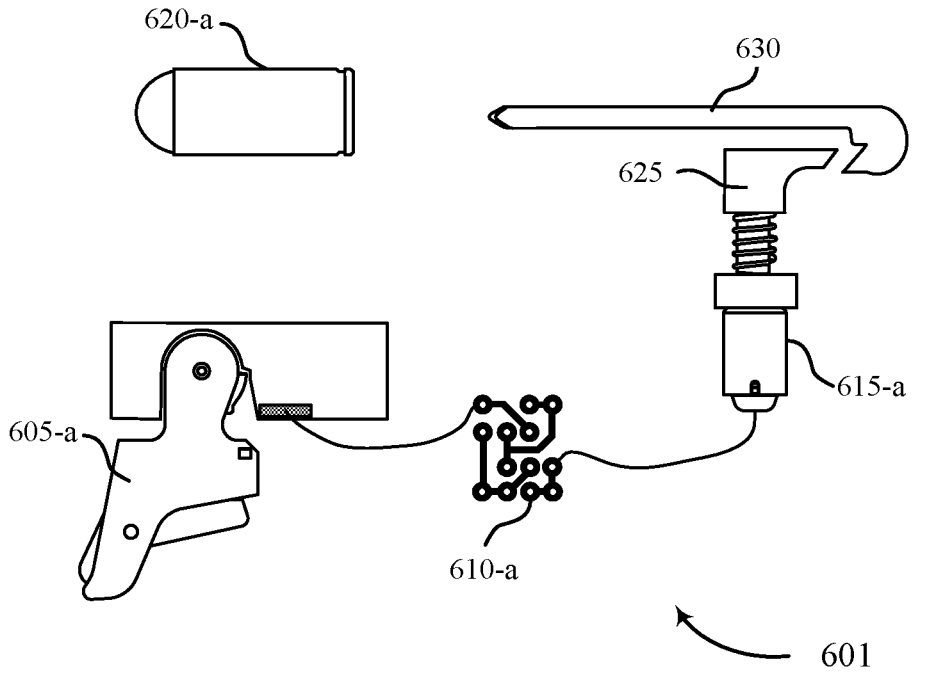
FIG. 6 illustrates an example of a firing system including an electronically controlled sear and an example of a firing system including an electronic firing pin.
Figure 6:
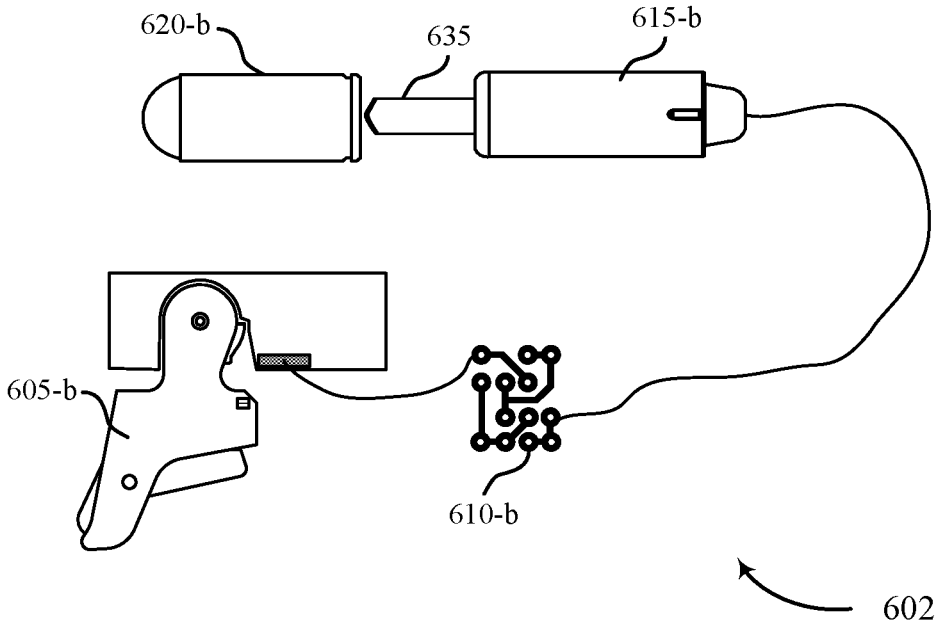

FIG. 6 illustrates an example of a firing system 601 including a synthetic trigger and an electronically controlled sear as well as an example of a firing system 602 including a synthetic trigger and an electronic firing pin.

The firing system 601 includes a trigger 605-*a*, a trigger sensor 610-*a*, and an actuator 615-*a*. The trigger sensor 610-*a* may identify movement of the trigger 605-*a* and transmit an electrical signal to the actuator 615-*a* in response to the movement. In some examples, the trigger sensor 610-*a* may identify a trigger break based on the trigger 605-*a* traveling a threshold distance, and the trigger sensor 610-*a* may transmit an electrical signal to the actuator 615-*a* in response to the trigger break. The electrical signal may activate the actuator 615-*a*, causing displacement of the sear 625 and release of the striker 630. The striker 630 may collide with the cartridge 620-*a*, causing a propellant to be ignited and a projectile to be fired from the firing system 601.

The firing system 602 includes a trigger 605-*b*, a trigger sensor 610-*b*, and an actuator 615-*b*. The trigger sensor 610-*b* may identify movement of the trigger 605-*b* and transmit an electrical signal to the actuator 615-*b* in response to the movement. In some examples, the trigger sensor 610-*b* may identify a trigger break based on the trigger 605-*b* traveling a threshold distance, and the trigger sensor 610-*b* may transmit an electrical signal to the actuator 615-*b* in response to the trigger break. The electrical signal may activate the actuator 615-*b*, causing the temperature of the firing pin 635 to increase. The firing pin 635 may be in contact with (or in close proximity to) the cartridge 620-*b*, so increasing the temperature of the firing pin 635 may cause a propellant to be ignited and a projectile to be fired from the firing system 602.

Figure 7:
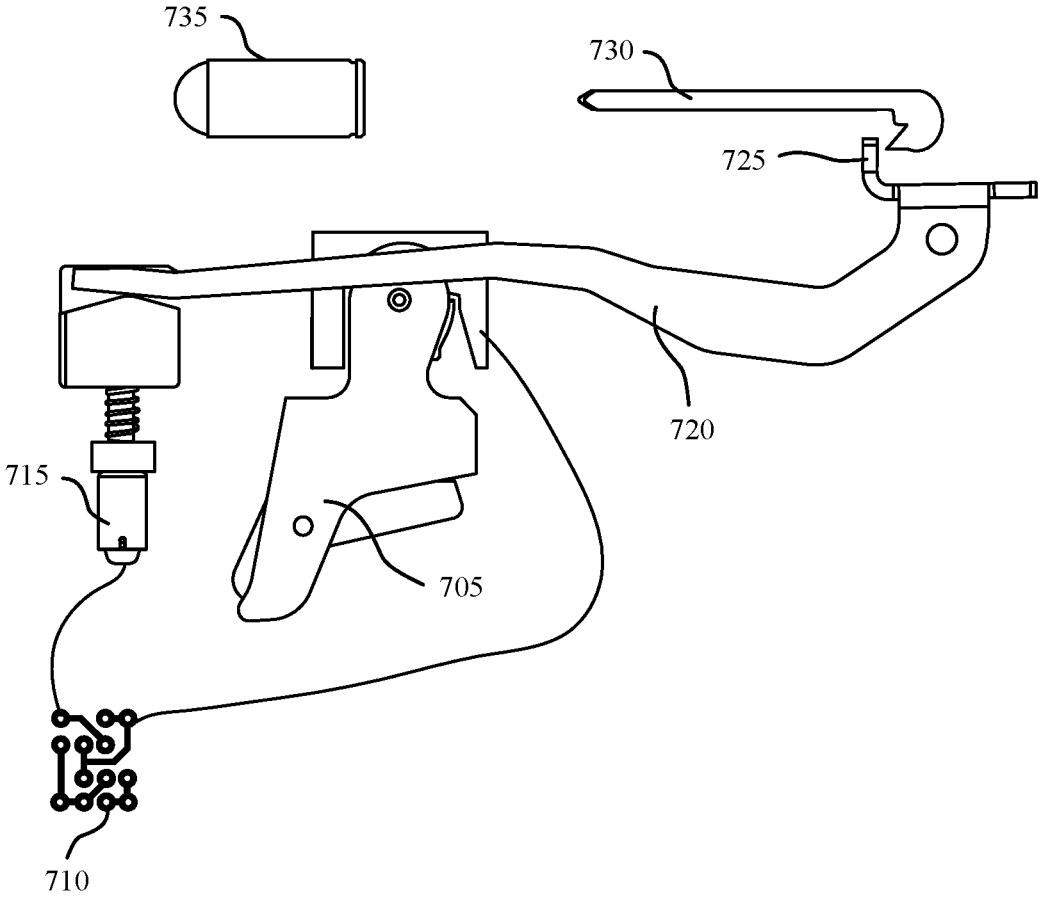
FIG. 7 illustrates an example of a firing system including an electronically controlled sear.

FIG. 7 illustrates an example of a firing system 700 including an electronically controlled sear.

The trigger sensor 710 may determine that movement of the trigger 705 satisfies a displacement threshold, and the trigger sensor 710 may transmit an electrical signal to the actuator 715 in response to the movement of the trigger 705. The electrical signal may activate the actuator 715 and cause movement of the actuator 715, which may result in displacement of the sear linkage 720 and the sear 725. The displacement of the sear 725 may release the striker 730 and allow the striker 730 to collide with the primer of the cartridge 735. The striker 730 colliding with the primer may cause combustion and a projectile to be fired from the firing system 700. The firing systems described with reference to FIG. 7 and FIG. 6 are examples of fire control mechanisms.

Figure 8:
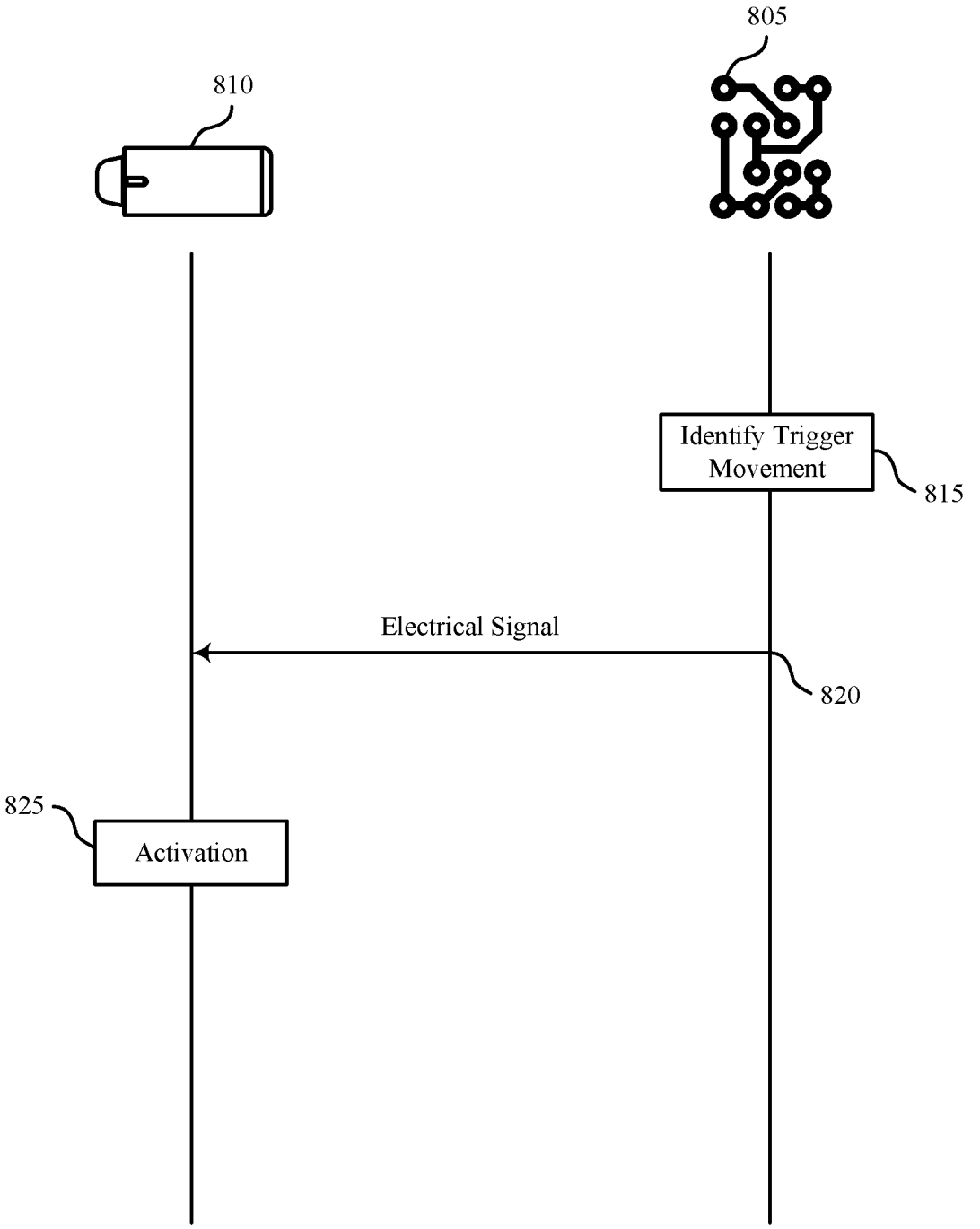
FIG. 8 illustrates an example of a process flow that supports a firing system including a synthetic trigger.

FIG. 8 illustrates an example of a process flow 800 that supports a fire control mechanism including a synthetic trigger. The process flow 800 includes a trigger sensor 805 and an actuator 810, which may be examples of the corresponding components described with reference to FIGS. 1 through 7. Alternative examples of the following may be implemented, where some steps are performed in a different order than described or are not performed at all. In some cases, steps may include additional features not mentioned below, or further steps may be added.

At step 815, the trigger sensor 805 may identify trigger movement. In some examples, the trigger movement may represent a trigger break. For example, the trigger sensor 805 may identify trigger movement based on a trigger displacement threshold being satisfied and/or a trigger force threshold being satisfied, and the trigger displacement threshold and/or the trigger force threshold may represent the trigger break.

At step 820, the trigger sensor 805 may generate an electrical signal, and the electrical signal may active the actuator 810.

At step 825, the actuator 810 may be activated by the electrical signal. The actuator 810 may move a mechanism or heat up a mechanism in response to being activated. As an example, the actuator 810 may release a sear or striker in response to being activated. As another example, the actuator 810 may increase the temperature of an electronic firing pin in response to being activated.

Figure 9:
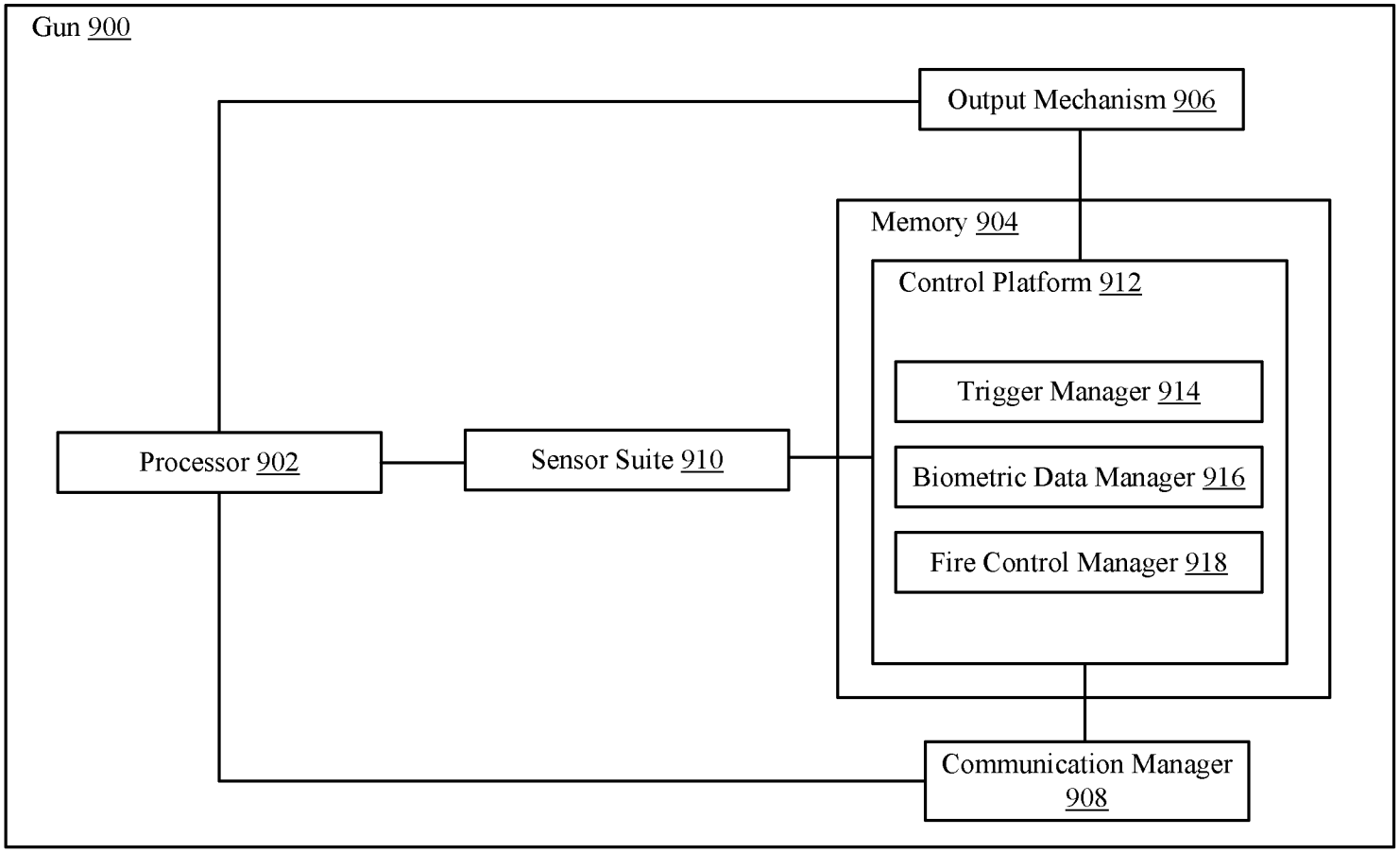
FIG. 9 illustrates an example of a gun that supports a synthetic trigger.

FIG. 9 illustrates an example of a gun 900 able to implement a control platform 912 designed to produce outputs that are helpful in ensuring the gun 900 is used in an appropriate manner. As further discussed below, the control platform 912 (also referred to as a "management platform" or a "signal manager") may be designed to manage aspects of a gun.

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an application-specific integrated circuit (ASIC) that provides control functions to the gun 900. As shown in FIG. 9, the processor 902 can be coupled with all components of the gun 900, either directly or indirectly, for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips or managers.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth, Wi-Fi®, NFC, and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint sensor or camera that generates images which can be used for, for example, biometric authentication. As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may include a trigger manager 914, a biometric data manager 916, and a fire control manager 918. As an illustrative example, the trigger manager 914 may process data generated by, and obtained from, a trigger sensor (e.g., a load cell, a photo interrupt sensor, a Hall effect sensor, etc.), the biometric data manager 916 may process data generated by, and obtained from, a facial recognition camera, and the fire control manager 918 may process data generated by an actuator. Because the data obtained by these managers may have different formats, structures, and content, the instructions executed by these managers can (and often will) be different. For example, the instructions executed by the trigger manager 914 to process data generated by a trigger sensor may be different than the instructions generated by biometric data manager 916 to process data generated by a camera. As a specific example, the biometric data manager 916 may implement image processing algorithms (e.g., for denoising, despeckling, etc.) that are not necessary for processing data generated by a trigger sensor.

Figure 10:
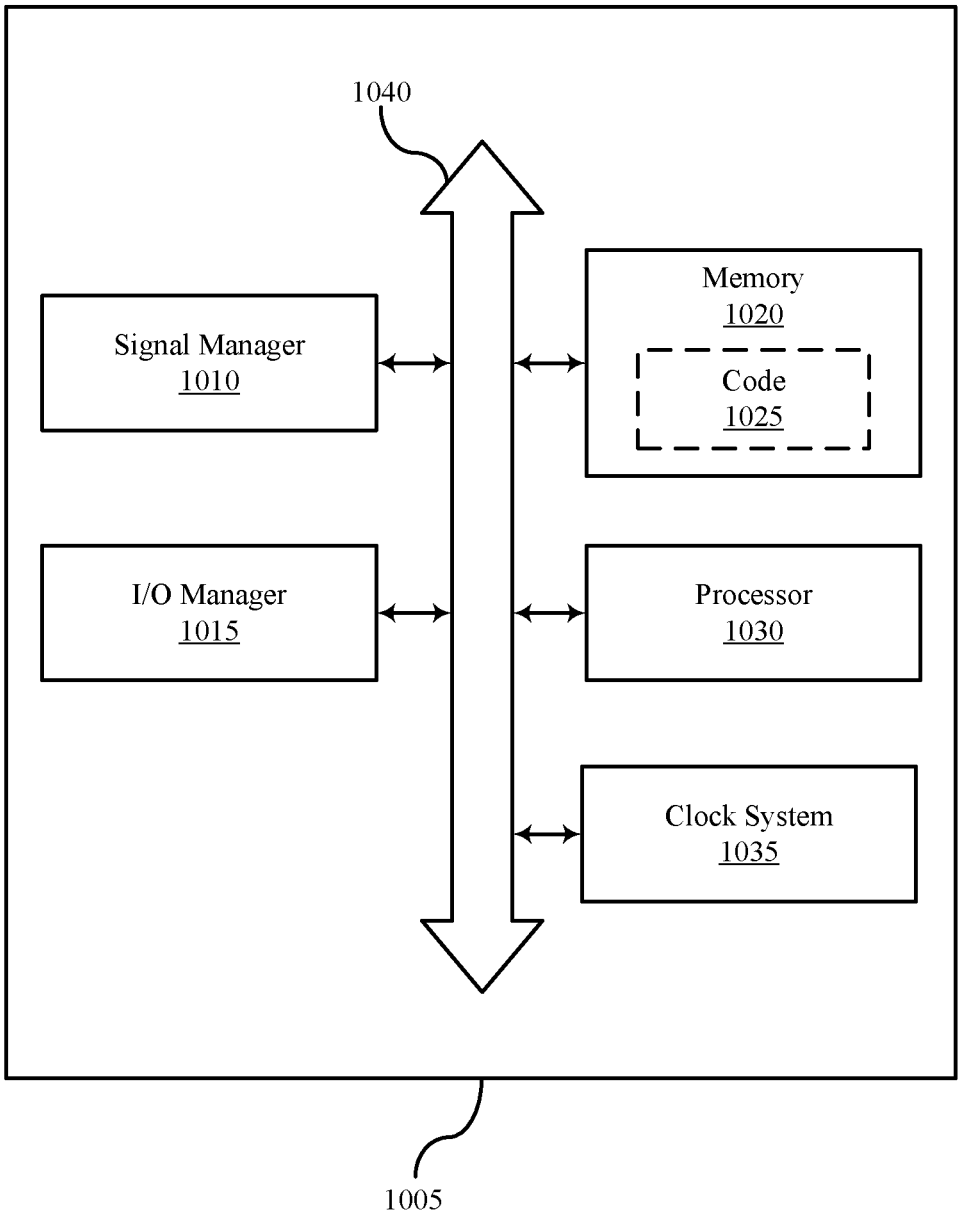
FIG. 10 illustrates an example of a system that supports a synthetic trigger.

FIG. 10 illustrates an example of a system 1000 that supports a synthetic trigger. The device 1005 may be operable to implement the techniques, technology, or systems disclosed herein. The device 1005 may include components such as a signal manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, a gun or a fire control system.

The signal manager 1010 may identify a trigger break and transmit an electrical signal to an actuator so as to activate the actuator. The signal manager 1010 may transmit the electrical signal in response to identifying the trigger break. Activating the actuator may result in disengagement of a safety and/or the firing of a projectile from the device 1005.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed the device may couple the trigger body with a trigger biasing device such that the trigger body is biased towards an inactive position, the code 1025 may cause the processor 1030 to perform various operations or functions described here.

The processor 1030 may be an example or component of a central processing unit (CPU), an application specific integrated circuit (ASIC), or a field programmable gate array (FPGA). In some embodiments, the processor 1030 may utilize an operating system or software such as Microsoft Windows®, iOS®, Android®, Linux®, Unix®, or the like. The clock system 1035 may control a timer for use by the disclosed embodiments.

The signal manager 1010, or its sub-components, may be implemented in hardware, software (e.g., software or firmware) executed by a processor, or a combination thereof. The signal manager 1010, or its sub-components, may be physically located in various positions. For example, in some cases, the signal manager 1010, or its sub-components may be distributed such that portions of functions are implemented at different physical locations by one or more physical components.

FIG. 11 illustrates an example of a flowchart 1100 showing a method of manufacturing a device. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a device that is able to implement aspects of the present disclosure (step 1105). For example, the manufacturer may machine, cut, shape, or otherwise make parts to be included in the device. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the device (or a component of the device). The device may be an example of a gun, a trigger system, a synthetic trigger, or any components thereof. As an illustrative example, the device may be a synthetic trigger that can be installed in a gun. As another illustrative example, the device may be a gun that includes a synthetic trigger.

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1110). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

Thereafter, the manufacturer may ship the gun to a dealer (step 1115). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1105 and 1110 either sequentially or simultaneously (e.g., one component may be tested while another component is added to the gun). Thus, the descriptions of these processes are intended to be open ended.

Figure 12:
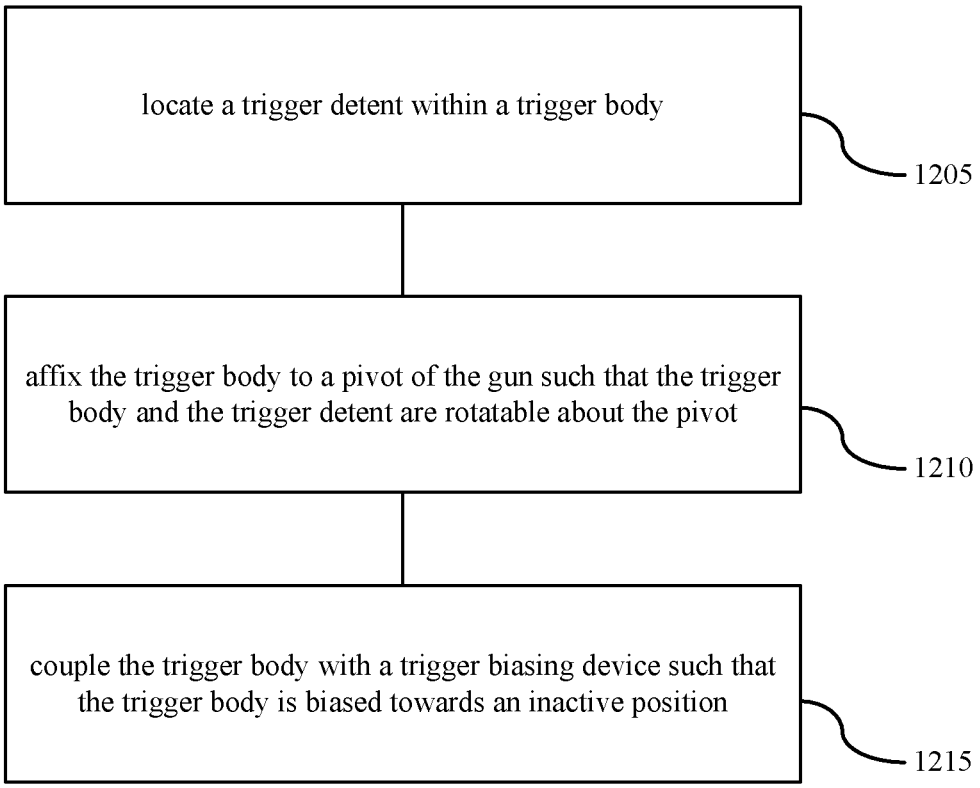
FIG. 12 illustrates an example of a flowchart showing a method of installing a synthetic trigger system.

FIG. 12 shows a flowchart illustrating a method 1200 of installing a synthetic trigger system in a gun. The operations of the method 1200 may be implemented by a manufacturer, a technician, an operator, or the like. In some examples, a device may execute a set of instructions to control the functional elements of the to perform the described functions.

At step 1205, the device may locate a trigger detent within a trigger body. In some examples, the device may locate the trigger detent within the trigger body such that a first portion of the trigger detent is located within an aperture of the trigger body, where a detent biasing device is configured to bias the trigger detent such that a second portion of the trigger detent protrudes from the aperture of the trigger body.

At step 1210, the device may affix the trigger body to a pivot of the gun such that the trigger body and the trigger detent are rotatable about the pivot.

At step 1215, the device may couple the trigger body with a trigger biasing device such that the trigger body is biased towards an inactive position.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

EXAMPLES

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a trigger system including: a trigger body coupled with a detent mechanism, wherein both the trigger body and the detent mechanism are moveable affixed to an axis of rotation; a first biasing mechanism coupled with the trigger body, wherein the first biasing mechanism is configured to bias the trigger body in a forward direction; and a second biasing mechanism coupled with the detent mechanism, wherein the second biasing mechanism is configured to bias the detent mechanism towards a surface that is in a displacement path of the detent mechanism, and wherein the detent mechanism is configured to produce (i) a tactile trigger wall based on contacting the surface and (ii) a tactile trigger break based on moving past the surface.

In some examples, the techniques described herein relate to a trigger system including: a trigger body movably affixed to a pivot; a trigger detent moveably affixed to the pivot; and a detent biasing device configured to bias the trigger detent towards an obstructing surface that is located in a displacement path of the trigger detent.

In some examples, the techniques described herein relate to a trigger system, further including: a trigger biasing additional device configured to bias the trigger body in a forward direction.

In some examples, the techniques described herein relate to a trigger system, wherein the trigger detent includes: a sloped surface that is configured to contact the obstructing surface as the trigger detent moves along the displacement path.

In some examples, the techniques described herein relate to a trigger system, wherein the trigger detent includes: a sloped surface that is configured to contact the obstructing surface as the trigger detent moves along the displacement path.

In some examples, the techniques described herein relate to a trigger system, wherein the trigger detent is configured to rotate about the pivot in a manner that is substantially similar to the trigger body.

In some examples, the techniques described herein relate to a trigger system, wherein the trigger detent is further configured to translate linearly and compress the detent biasing device in response to contacting the obstructing surface.

In some examples, the techniques described herein relate to a trigger system, wherein the obstructing surface includes a leaf spring.

In some examples, the techniques described herein relate to a trigger system, wherein the obstructing surface is configured to remain stationary relative to the trigger detent.

In some examples, the techniques described herein relate to a trigger system, further including: a trigger sensor configured to generate an electrical signal in response to the trigger detent moving past the obstructing surface.

In some examples, the techniques described herein relate to a trigger system, wherein the trigger sensor includes a Hall effect sensor, a load cell, a photo-interrupt sensor, a mechanical switch, or any combination thereof.

In some examples, the techniques described herein relate to a trigger system, wherein, as a result of generating the electrical signal, an electromechanical safety is removed, a gun fires a projectile, or both.

In some examples, the techniques described herein relate to a trigger system including: a trigger body; a trigger detent; and means for biasing the trigger detent towards an opposing surface. In some examples, the means for biasing the trigger detent is a spring, such as a coil spring or a torsion spring.

In some examples, the techniques described herein relate to a trigger system, further including: means for biasing the trigger body towards a default position.

In some examples, the techniques described herein relate to a trigger system, wherein the means for biasing the trigger detent is configured to bias the trigger detent in a first direction, and wherein the means for biasing the trigger body is configured to bias the trigger body is a second direction that is substantially opposite the first direction.

In some examples, the techniques described herein relate to a method of installing a trigger system in a gun, the method including: locating a trigger detent within a trigger body such that a first portion of the trigger detent is located within an aperture of the trigger body, wherein a detent biasing device is configured to bias the trigger detent such that a second portion of the trigger detent protrudes from the aperture of the trigger body; affixing the trigger body to a pivot of the gun such that the trigger body and the trigger detent are rotatable about the pivot; and coupling the trigger body with a trigger biasing device such that the trigger body is biased towards an inactive position.

In some examples, the techniques described herein relate to a method, further including: compressing the detent biasing device so as to move the trigger detent and locate an opposing surface on a displacement path of the trigger detent.

In some examples, the techniques described herein relate to a method, wherein an opposing surface is located on a displacement path of the trigger detent, and wherein the opposing surface is configured to remain substantially stationary relative to the trigger detent.

In some examples, the techniques described herein relate to a method, wherein an opposing surface is located on a displacement path of the trigger detent, and wherein the opposing surface includes a leaf spring.

In some examples, the techniques described herein relate to a method, further including: testing the trigger system to verify that a trigger break of the trigger system includes a predetermined trigger weight.

In some examples, the techniques described herein relate to a method, wherein the trigger break is defined by the trigger detent moving past an opposing surface.

In some examples, the techniques described herein relate to a method, further including: testing the trigger system to verify that a trigger signal is generated is response to pulling the trigger body and forcing the trigger detent past an opposing surface.

In some examples, the techniques described herein relate to a method, further including: testing the gun to verify that the gun fires in response to pulling the trigger body and forcing the trigger detent past an opposing surface.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a signal manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A trigger system for a gun that includes a muzzle and either a striker or a hammer, the trigger system comprising:
- a sear configured to retain and selectively release a striker or a hammer;
- a trigger body movably affixed to a pivot;
- a trigger biasing device configured to bias the trigger body towards a muzzle of the gun;
- a trigger detent moveably affixed to the pivot; and
- a detent biasing device configured to bias the trigger detent away from the muzzle of the gun and towards an obstructing surface that is located in a displacement path of the trigger detent.

2. The trigger system of claim 1, wherein the obstructing surface is configured to i) remain stationary relative to the trigger detent and ii) direct the trigger detent towards the muzzle of the gun.

3. The trigger system of claim 1, wherein the trigger detent comprises:
- a sloped surface that is configured to contact the obstructing surface as the trigger detent moves along the displacement path.

4. The trigger system of claim 1, wherein the trigger detent comprises:
- an oblong aperture, wherein the trigger detent is moveably affixed to the pivot based at least in part on the oblong aperture being located around the pivot.

5. The trigger system of claim 1, wherein the trigger detent is configured to rotate about the pivot in a manner that is substantially similar to the trigger body.

6. The trigger system of claim 5, wherein the trigger detent is further configured to translate linearly and compress the detent biasing device in response to contacting the obstructing surface.

7. The trigger system of claim 1, wherein the obstructing surface comprises a leaf spring.

8. The trigger system of claim 1, wherein the obstructing surface is configured to remain stationary relative to the trigger detent.

9. The trigger system of claim 1, further comprising:
- a trigger sensor configured to generate an electrical signal in response to the trigger detent moving past the obstructing surface.

10. The trigger system of claim 9, wherein the trigger sensor comprises a Hall effect sensor, a load cell, a photo-interrupt sensor, a mechanical switch, or any combination thereof.

11. The trigger system of claim 9, wherein, as a result of generating the electrical signal, an electromechanical safety is removed, a gun fires a projectile, or both.

12. The trigger system of claim 1, wherein the pivot is a trigger pin, and wherein the trigger detent comprises:
- an oblong aperture, wherein the trigger detent is moveably affixed to the pivot based on the oblong aperture enveloping the trigger pin.

13. The trigger system of claim 1, wherein the trigger detent comprises:

an oblong aperture configured to envelope the pivot, wherein the oblong aperture directs, in response to the trigger detent contacting the obstructing surface, linear movement of the trigger detent against the detent biasing device.

14. The trigger system of claim 1, wherein the trigger detent comprises an oblong aperture configured to envelope the pivot, wherein the oblong aperture directs, in response to the trigger detent contacting the obstructing surface, movement of the trigger detent towards the muzzle of the gun.

15. A trigger system for a gun that includes a muzzle and either a striker or a hammer, the trigger system comprising:

a sear configured to retain and selectively release a striker or a hammer;

a trigger body movably affixed to a pivot;

a trigger biasing device configured to bias the trigger body towards a muzzle of the gun;

a trigger detent moveably affixed to the pivot; and a detent biasing device configured to bias a surface of the trigger detent away from the muzzle of the gun and towards an obstructing surface that is located in a displacement path of the surface, wherein the trigger detent is configured to rotate about the pivot based on the surface of the trigger detent moving past the obstructing surface.

16. The trigger system of claim 15, wherein the trigger detent is further configured to rotate about the pivot based on the trigger detent moving towards the muzzle of the gun.

17. The trigger system of claim 15, wherein the detent biasing device is a spring, and wherein the trigger detent is configured to rotate about the pivot based on the trigger detent compressing the spring.

18. The trigger system of claim 15, wherein the detent biasing device is a spring, and wherein the trigger detent is configured to rotate about the pivot based on (i) the trigger detent compressing the spring and (ii) the trigger detent moving linearly into an aperture of the trigger body.

19. The trigger system of claim 15, wherein the trigger body is configured to rotate about the pivot based on the surface of the trigger detent moving past the obstructing surface.

* * * * *